United States Patent [19]

Delfosse et al.

[11] 3,934,825

[45] *Jan. 27, 1976

[54] PROCESS FOR THE WET GRINDING OF MATERIALS

[75] Inventors: Pierre Delfosse, Paris, France; Alfred Bosshard, Oftringen, Switzerland

[73] Assignee: Plüss-Staufer AG, Switzerland

[ * ] Notice: The portion of the term of this patent subsequent to Sept. 9, 1992, has been disclaimed.

[22] Filed: Oct. 23, 1973

[21] Appl. No.: 408,878

[30] Foreign Application Priority Data

July 9, 1972 Germany ..... 2334804

[52] U.S. Cl. ..... 241/16; 241/30; 241/184; 241/DIG. 2

[51] Int. Cl.[2] ..... B02C 17/14

[58] Field of Search ..... 241/16, 30, 184, DIG. 2, 241/DIG. 7

[56] References Cited

UNITED STATES PATENTS

| | | | |
|---|---|---|---|
| 3,337,140 | 8/1967 | Wahl | 241/21 |
| 3,534,911 | 10/1970 | Gwilliam | 241/16 |
| 3,582,003 | 6/1971 | Langstroth | 241/30 X |
| 3,604,634 | 9/1971 | Windle | 241/16 |
| 3,677,476 | 7/1972 | Harned | 241/30 X |

*Primary Examiner*—Granville Y. Custer, Jr.
*Assistant Examiner*—Craig R. Feinberg
*Attorney, Agent, or Firm*—Pollock, Vande Sande & Priddy

[57] ABSTRACT

A process is disclosed for the wet grinding of a material such as chalk comprising the steps of preparing a suspension containing material particles no coarser than 43 microns and grinding the material in suspension using grinding bodies having a density of at least 3.7 g/cc, wherein the weight ratio of the grinding bodies to the material is at least 6:1. Specific types of grinding bodies are also disclosed.

16 Claims, No Drawings

PROCESS FOR THE WET GRINDING OF MATERIALS

CROSS REFERENCE TO RELATED APPLICATION

The invention disclosed in this application is related to the invention disclosed in applicant's copending application No. 401,487 for Mill for Grinding Materials, filed on Sept. 27, 1973 now U.S. Pat. No. 3,904,130.

This invention relates to processes for the wet grinding of materials in suspension, the ground materials subsequently being used, for example as pigments or fillers.

In hitherto proposed processes for wet grinding, ball mills are mainly used. These form products containing more than 40% by weight of particles with a diameter smaller than 2 microns. It has also been proposed hitherto to use mills with grinding bodies which consist of quartz bodies such as, for example, "sable d'Ottawa", calcined clay or preferably glass balls.

These hitherto proposed processes for wet grinding generally lead to products having a comparatively low degree of fineness. When an attempt is made to obtain products with a high degree of fineness, using such hitherto proposed processes, the resultant products are grey because of abrasion of the grinding bodies, abrasion of the mill lining, which usually consists of a synthetic plastics material, and because of increases in temperature during grinding to 90° to 100°C.

According to the present invention there is provided a process for the wet grinding of a material in suspension wherein the grinding is effected using grinding bodies having a density of at least 3.7 g/cc, the mineral in suspension containing no particles coarser than 43 microns, and the weight ratio of the grinding bodies to the material to be ground is at least 6.

Using a grinding process in accordance with the invention it is possible to achieve a high throughput and a product containing at least 85% by weight of particles smaller than 1 micron, with 65% by weight of particles smaller than 0.5 microns, while a good degree of whiteness is maintained. Furthermore, the ground particles can have a specific surface area of more than 10 sq.m/g. The energy consumed can be less than $150 \times 10^6$ kg-m/hour/ton of dry chalk.

Polyacrylates are preferably used as dispersing agents in the grinding.

The concentration of material to be ground in the suspension is preferably from 40 to 70 weight percent.

The volume ratio of the grinding bodies to that of the suspension is preferably at least 1.5.

The grinding bodies preferably consist of 30 to 70 weight percent of zirconium oxide, 0.1 to 5 weight percent of aluminium oxide and 5 to 20 weight percent of silicon dioxide. Grinding bodies of $ZrSiO_4$ can also be used.

In the hitherto proposed processes the weight ratio of the grinding bodies to the material to be ground was not more than 5. The higher weight ratio of grinding bodies to material to be ground of at least 6 has an advantageous effect.

The following Example is given by way of illustration only.

In a mill having microelements and 1.008 kg of zirconium silicate balls with a diameter between 1 and 2.5 mm, chalk was ground in suspension at a concentration of 63 weight percent in the presence of 0.3 weight percent of polyacrylate, the percentages being by weight based on the dry chalk.

The weight ratio of the grinding bodies to dry calcium carbonate was 6.5. The volume ratio of the grinding bodies to the chalk suspension was 1.6. The consumption of energy was 146,800,000 Kg-m/hour/ton of dry chalk.

The degree of whiteness of the resultant product was 88 (Filter Tappi R 457).

A comparison of this process in accordance with the invention with a hitherto proposed process is shown in the following in Table.

| | density of grinding bodies | weight ratio of grinding bodies to material to be ground | volume ratio of grinding elements of suspension volume | energy consumption (kgm/hour/ton of dry chalk) | fineness | specific surface area sq.m/g. | degree of whiteness (Tappi R 457 |
|---|---|---|---|---|---|---|---|
| starting material | | | | | all parts below 43μ 40 weight percent of particles < 2μ | 2.5 | 80 |
| glass balls | 2.7 | 4.3:1 | 1.6:1 | 248,000,000 | 85 weight percent of particles < 1μ 65 weight percent of particles < 0.5μ | 12 | 86.5 |
| $ZrSiO_4$ balls | 3.7 | 6:1 | 1.6:1 | 146,800,000 | 85 weight percent of particles < 1μ, 65 weight percent of particles < 0.5μ | 12 | 88 |

Very fine minerals which can be obtained by a process in accordance with the invention, such as calcium carbonate, dolomite, talc, barite, and kaolin etc. can be used, for example, for paper coating, in the paint and varnish industries, and in plastics etc.

What we claim is:

1. A process for the wet grinding of a material such as chalk, comprising the steps of:

forming a suspension containing particles of said material no coarser than 43 microns; and grinding said suspension of material with grinding bodies having a weight density of at least 3.7 g/cc and consisting of 30 to 70 weight percent of zirconium oxide, 0.1 to 5 weight percent of aluminum oxide and 5.0 to 20 weight percent of silicon dioxide, wherein the weight ratio of said grinding bodies to said material to be ground is at least 6:1.

2. A process according to claim 1, wherein a polyacrylate is used as a dispersing agent in said suspension.

3. A process according to claim 2, wherein said material to be ground forms 40 to 70 weight percent of said suspension.

4. A process according to claim 3, wherein the volume ratio of said grinding bodies to that of said suspension is at least 1.5:1.

5. A process according to claim 4, wherein said grinding bodies have diameters between 1 and 2.5 mm.

6. A process according to claim 2, wherein the volume ratio of said grinding bodies to that of said suspension is at least 1.5:1.

7. A process according to claim 6, wherein said grinding bodies have diameters between 1 and 2.5 mm.

8. A process according to claim 2, wherein said grinding bodies have diameters between 1 and 2.5 mm.

9. A process according to claim 8, wherein said material to be ground forms 40 to 70 weight percent of said suspension.

10. A process according to claim 1, wherein said material to be ground forms 40 to 70 weight percent of said suspension.

11. A process according to claim 10, wherein the volume ratio of said grinding bodies to that of said suspension is at least 1.5:1.

12. A process according to claim 11, wherein said grinding bodies have diameters between 1 and 2.5 mm.

13. A process according to claim 10, wherein said grinding bodies have diameters between 1 and 2.5 mm.

14. A process according to claim 1, wherein the volume ratio of said grinding bodies to that of said suspension is at least 1.5:1.

15. A process according to claim 14, wherein said grinding bodies have diameters between 1 and 2.5 mm.

16. A process according to claim 1, wherein said grinding bodies have diameters between 1 and 2.5 mm.

* * * * *